US006299273B1

(12) United States Patent
Anderson et al.

(10) Patent No.: US 6,299,273 B1
(45) Date of Patent: Oct. 9, 2001

(54) METHOD AND APPARATUS FOR THERMAL CONTROL OF AN INK JET PRINTHEAD

(75) Inventors: Frank Edward Anderson, Sadieville; Stanley Dyer; Christopher Dane Jones, both of Georgetown; Shirish Padmaker Mulay; William Shannon Spencer, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/617,136

(22) Filed: Jul. 14, 2000

(51) Int. Cl.[7] ..... B41J 29/38; B41J 29/393
(52) U.S. Cl. ..... 347/17; 347/19
(58) Field of Search ..... 347/14, 17, 18, 347/19

(56) References Cited

U.S. PATENT DOCUMENTS

| | | |
|---|---|---|
| 4,536,774 | 8/1985 | Inui et al. . |
| 4,791,435 | 12/1988 | Smith et al. . |
| 4,872,028 | 10/1989 | Lloyd . |
| 4,980,702 | 12/1990 | Kneezel et al. . |
| 5,036,337 | 7/1991 | Rezanka . |
| 5,107,276 | 4/1992 | Kneezel et al. . |
| 5,168,284 | 12/1992 | Yeung . |
| 5,300,969 | 4/1994 | Miura et al. . |
| 5,315,316 | 5/1994 | Khormaee . |
| 5,745,132 | 4/1998 | Hirabayashi et al. . |
| 5,815,173 | 9/1998 | Silverbrook . |
| 5,841,452 | 11/1998 | Silverbrook . |
| 5,877,785 | 3/1999 | Iwasaki et al. . |
| 5,907,331 | 5/1999 | Markham . |
| 5,986,684 | 11/1999 | Ohashi . |
| 6,019,449 | 2/2000 | Bullock et al. . |
| 6,019,457 | 2/2000 | Silverbrook . |

FOREIGN PATENT DOCUMENTS

| | | |
|---|---|---|
| 0872345A2 | 10/1998 | (EP) . |
| 63-276563 * | 11/1988 | (JP) . |

* cited by examiner

*Primary Examiner*—N. Le
*Assistant Examiner*—Michael P. Nghiem
(74) *Attorney, Agent, or Firm*—Taylor & Aust, P.C.

(57) ABSTRACT

A method of controlling a temperature of a print chip of a printhead in an ink jet printer includes providing the printer with a memory device. The print chip is provided with and at least one ink-jetting resistor. The printhead is provided with at least one substrate heater and a heatsink attached to the print chip. Power is applied to the substrate heater and/or the ink-jetting resistor. Temperature data associated with the print chip is recorded during the applying step. A thermal resistance value of the print chip to the heatsink and/or a thermal capacitance value associated with the printhead is calculated dependent upon the recorded temperature data. The thermal resistance value of the print chip to the heatsink and/or the thermal capacitance value associated with the printhead are stored in the memory device. A temperature of the heatsink is measured based upon the thermal resistance value of the print chip to the heatsink, the thermal capacitance value associated with the printhead, a temperature of the print chip, an ambient temperature, and/or a thermal resistance value associated with the heatsink. A level of power to be applied to the substrate heater is set dependent upon the thermal resistance value of the print chip to the heatsink and/or the thermal capacitance value associated with the printhead, and the temperature of the heatsink.

21 Claims, 6 Drawing Sheets

METHOD AND APPARATUS FOR THERMAL CONTROL OF AN INK JET PRINTHEAD

BACKGROUND OF THE INVENTION

1. Field of the Invention

The present invention relates to an ink jet printhead, and, more particularly, to a method and apparatus for thermal control of an ink jet printhead.

2. Description of the Related Art

In an ink jet printer, the drop and mass of the ink are dependent upon the temperature of the head. If the temperature of the head varies significantly from swath to swath, then a color shift will become visible, a phenomenon which is referred to as "banding." In order to overcome this problem, ink jet printers typically add heat to the print chips by the use of substrate heaters. It is known for a print chip of an inkjet printer to be attached to a plastic support. Such plastic supports typically do not remove heat from the print chip in an efficient manner and therefore the ability to print dense areas on the page is thermally limited.

In order to provide a better path for heat to escape to the ambient air, it is also known for print chips to be attached to a metal body or heatsink. By attaching the print chip to a metal heatsink, swings in chip temperature are reduced. However, the use of a metal heatsink significantly affects the thermal control of the print chip.

As ink jet printers begin to move into the business market, it becomes necessary to manage the printhead in a more efficient manner. The use of print chips attached to heatsinks for use in an inkjet printer requires improvements to the known print chip temperature control methods. What is needed in the art is a method of more accurately controlling the temperature of a print chip.

SUMMARY OF THE INVENTION

The present invention provides a method of storing thermal characteristics of a print chip in a memory attached to the printhead, and using the thermal information to select a level of substrate heater power in order to more uniformly control the chip temperature. Variations in the mounting of the print chips are overcome through the use of calibration techniques. By using the thermal information stored in the memory, calibration is significantly improved, resulting in a printer that is better suited for business applications.

The invention comprises, in one form thereof, a method of controlling a temperature of a print chip of a printhead in an ink jet printer. The printer is provided with a memory device. The print chip is provided with and at least one ink-jetting resistor. The printhead is provided with at least one substrate heater and a heatsink attached to the print chip. Power is applied to the substrate heater and/or the inkjetting resistor. Temperature data associated with the print chip is recorded during the applying step. A thermal resistance value of the print chip to the heatsink and/or a thermal capacitance value associated with the printhead is calculated dependent upon the recorded temperature data. The thermal resistance value of the print chip to the heatsink and/or the thermal capacitance value associated with the printhead are stored in the memory device. A temperature of the heatsink is measured based upon the thermal resistance value of the print chip to the heatsink, the thermal capacitance value associated with the printhead, a temperature of the print chip, an ambient temperature, and/or a thermal resistance value associated with the heatsink. A level of power to be applied to the substrate heater is set dependent upon the thermal resistance value of the print chip to the heatsink and/or the thermal capacitance value associated with the printhead, and the temperature of the heatsink.

The invention comprises, in another form thereof, an ink jet printer including a printhead having a substrate heater, a print chip, and a heatsink attached to the print chip. A memory device stores a thermal resistance value of the print chip to the heatsink. A controller retrieves the thermal resistance value from the memory device and sets a level of power to be applied to the substrate heater dependent upon a temperature of the heatsink and the thermal resistance value of the print chip to the heatsink An advantage of the present invention is that the temperature of the print chip can be more uniformly controlled.

Another advantage is that the temperature of the print chip can be more accurately predicted.

Yet another advantage is that the temperature of the print chip can be more reliably prevented from exceeding a predetermined limit temperature.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
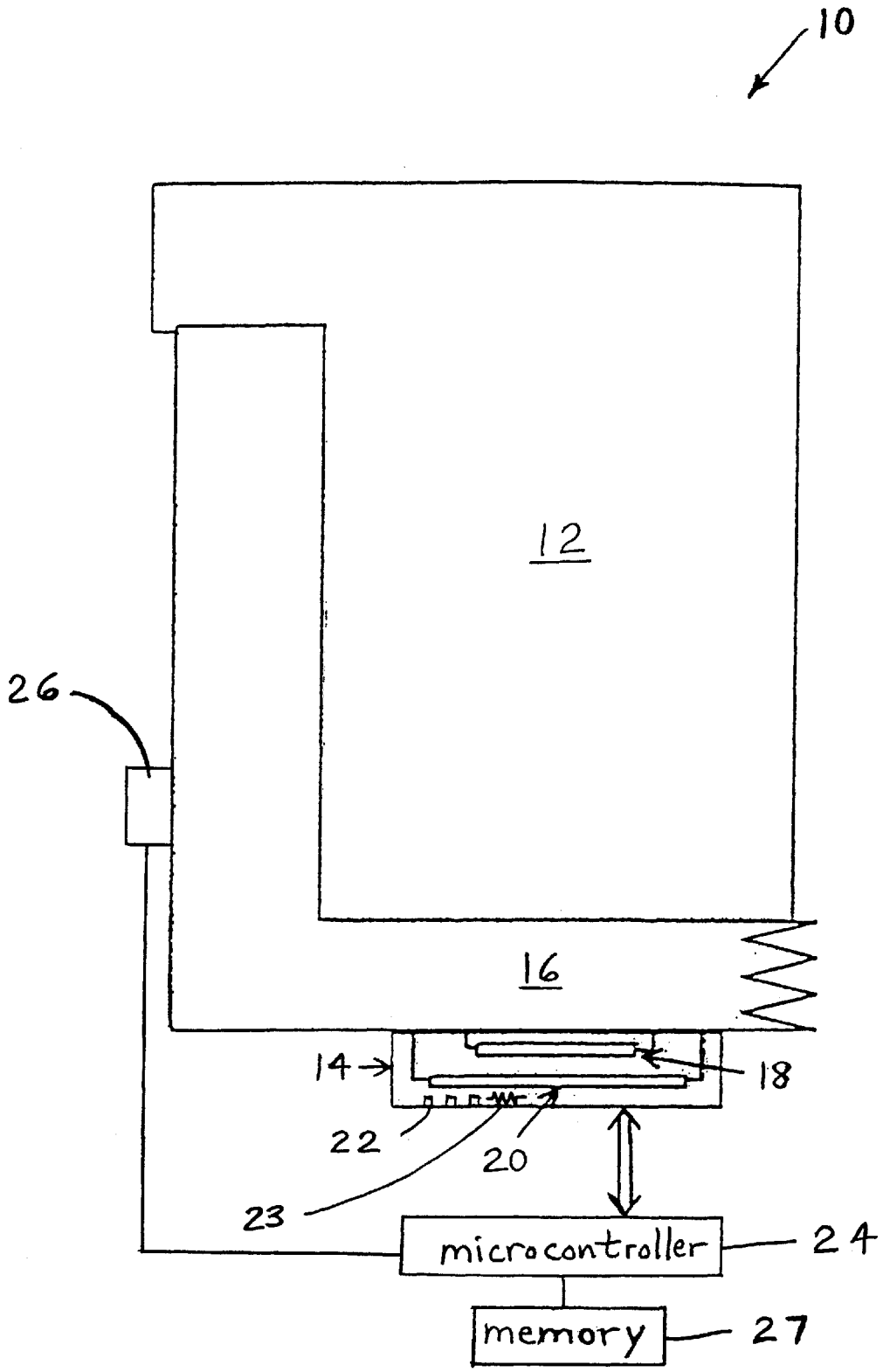
FIG. 1 is a schematic view of a printhead, microcontroller and associated memory that can be used in the method of the present invention.

Referring now to the drawings and particularly to FIG. 1, there is shown one embodiment of a printhead 10 that can be used in the method of the present invention. Printhead 10 includes an ink tank 12 and an ink jet chip 14 mounted to a metal heatsink 16. Print chip 14 includes an on-chip temperature sense resistor 18 for measuring the chip's temperature, and a substrate heater 20 which allows the application of additional power to chip 14. Substrate heater 20 may be in the form of a plurality of substrate heaters. Ink jet chip 14 includes ink-emitting nozzles 22, only a few of which are shown. Each ink-emitting nozzle 22 is associated with a respective ink-jetting resistor 23, only one of which is shown. Ink jet chip 14 is in bi-directional communication with a microcontroller 24 connected both to a memory device 26 attached to heatsink 16 and to a non-volatile memory device (NVRAM) 27 within the printer. Non-volatile memory device 27 can be attached to print chip 14.

The temperature of printhead 10 and its ink usage is controlled through the use of memory 26. Memory 26 contains information such as the type of printhead, the energy required to emit a drop of ink, the number of drops fired, etc. Memory 26 is nonvolatile and can be written to so that information about a printhead "follows" that printhead regardless of the machine that the printhead goes into. Information describing the parameters of print chip 14 is also stored in memory 26 and is used in the method of thermal control to improve system performance.

The thermal resistance of print chip 14 to heatsink 16 can vary significantly. For example, a change of 1° C. per watt in a system where the total thermal resistance is 8° C. per watt is significant. Therefore, an "in the printer" calibration of the thermal characteristics from print chip 14 to heatsink 16 when heating with substrate heater 20 improves the accuracy of the thermal control. The thus calibrated thermal characteristics are stored in memory 26. Due to the length of time required to measure thermal resistance, it is not a parameter that is practical to measure while printing. Storing the resistance of substrate heater 20 in memory 26 eliminates a large portion of the error when calibrating for thermal resistance.

In order to prevent excessive changes in print temperature, it is necessary to examine the print data before it is printed and to predict whether the print data will cause such an excessive change in print temperature. Accuracy in this prediction requires that the temperature of heatsink 16 is either measured or predicted. Thus, accurately predicting the temperature of heatsink 16 minimizes cost and maximizes throughput.

Selection of certain control parameters in the printer requires that the printer measure the ambient air temperature. When print chip 14 is mounted to metal heatsink 16, the output of temperature sense resistor 18 is used to measure the temperature of heatsink 16. The ambient air temperature is calculated by tracking the temperature of print chip 14 over a fixed period of time, and by using the cooling characteristics of heatsink 16.

In a control system where the temperature is maintained by either turning off the heaters or applying a fixed control voltage value to the heaters until a desired change of temperature occurs, selection of the control voltage value affects the performance of the system. In an ink jet printer that uses such a control system and metal heatsinks, selection of the control voltage value based upon the thermal characteristics of print chip 14 and the temperature of heatsink 16 improves system performance.

The thermal characteristics of the system are different if the heat is generated from jetting ink rather than from use of substrate heater 20. Prediction of the temperature of print chip 14 during a next swath is improved when a calibration has been completed. Such a calibration sequence involves ejecting ink into a maintenance station while monitoring the temperature of print chip 14. This calibration provides parameters associated with jetting ink, including the effect of ink flow and ejection efficiency.

Figure 2:
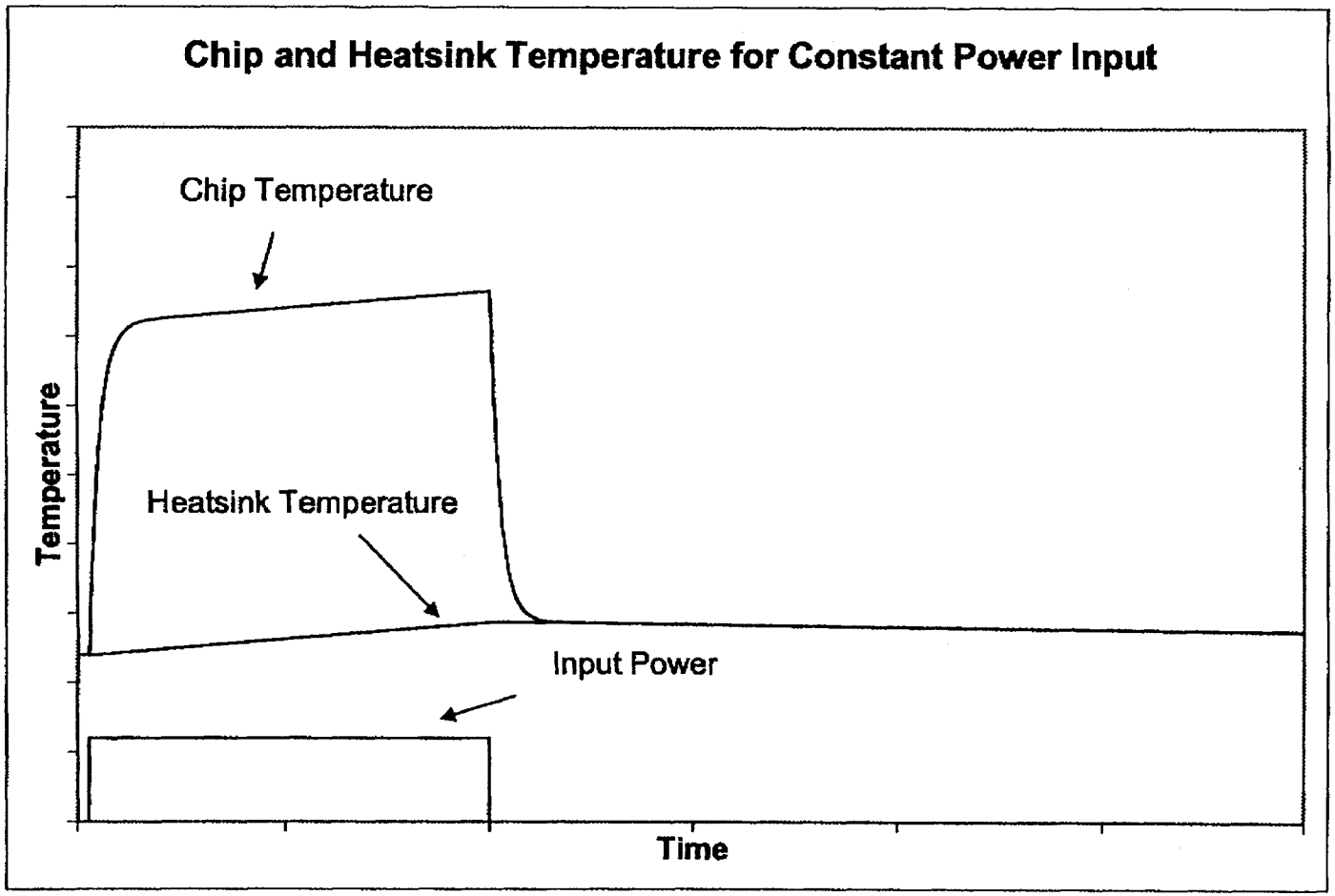
FIG. 2 is a plot of print chip temperature, heatsink temperature, and power applied to the substrate heaters.

FIG. 2 is a plot of the heating and cooling of the chip 14 mounted on heatsink 16 when a constant level of power is applied thereto. The shape of the plot is dependent upon the thermal parameters associated with print chip 14 and heatsink 16, as well as the type of attachment between chip 14 and heatsink 16. The response of the temperature of chip 14 can be grouped into either its fast time response components, due to print chip 14, or its slow time response components, due to heatsink 16. The control of the chip temperature is improved by characterizing these time constants in the machine at the time of installation of printhead 10, and storing them in memory 26.

Figure 3:
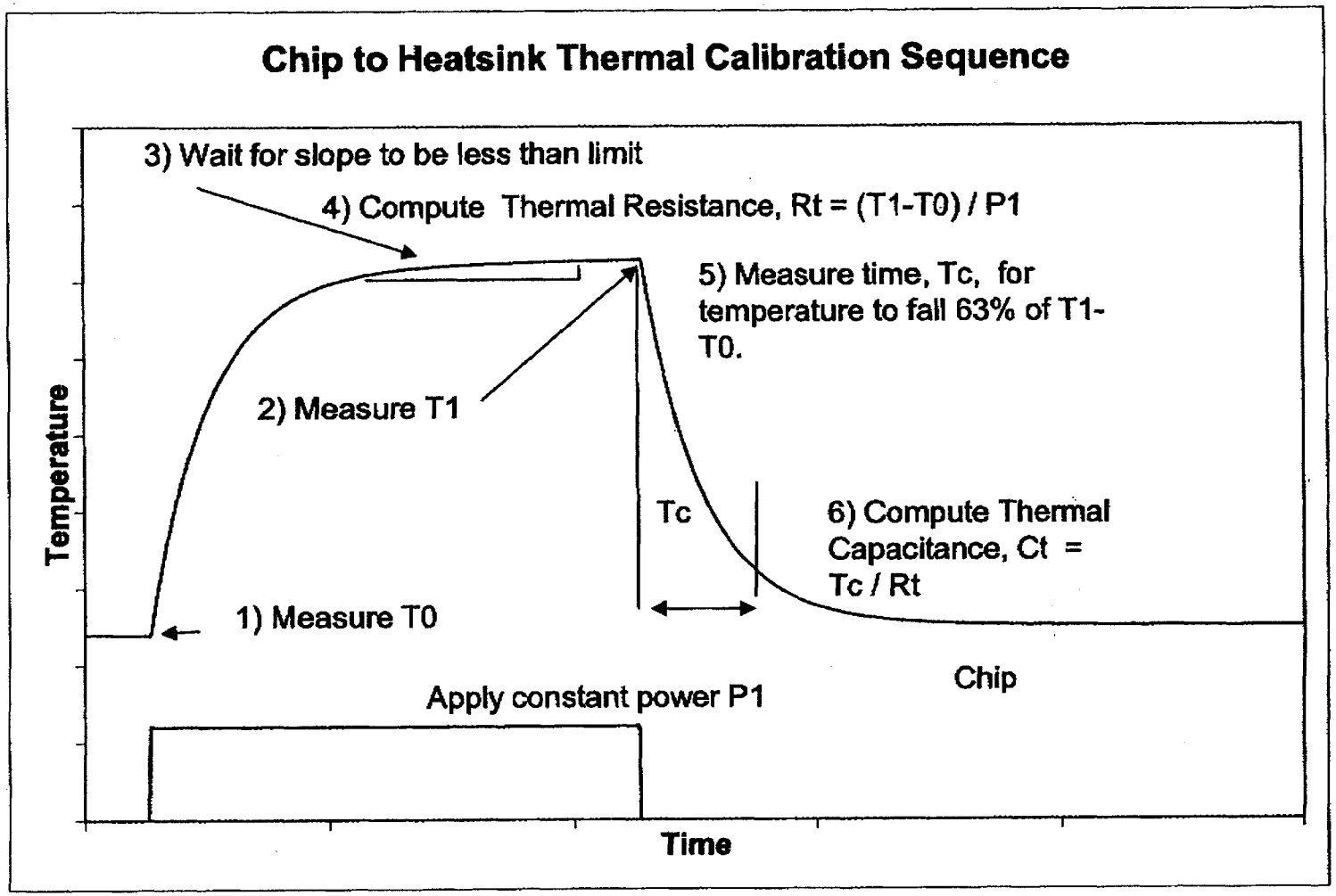
FIG. 3 is a plot of print chip temperature during a calibration sequence.

The sequence for chip to heatsink thermal resistance calibration is illustrated in FIG. 3. After the temperature of chip 14 has reached T0, the temperature of heatsink 16, a fixed level of power is applied to substrate heater 20. The level of power is computed using the nominal system parameters stored in memory 26 and information describing print chip 14, which is also stored in memory 26.

The rate of change of the temperature of chip 14 is monitored as the fixed level of power is applied to substrate heater 20. When the rate of change of the chip temperature falls below a predetermined threshold, the temperature of print chip 14 is measured (T1) and the power to substrate heater 20 is discontinued.

The difference between the peak temperature T1 and the initial temperature T0 is computed and divided by the power applied to yield the thermal resistance between chip 14 and heatsink 16. In order to calculate the thermal capacitance, the difference between the peak temperature T1 and the initial temperature T0 is scaled by 37%. This value is added to the initial temperature to form the time constant cooling detection temperature. When the temperature of chip 14 falls below the cooling detection temperature, the time period Tc that was required to cool from peak temperature T1 to the cooling detection temperature is recorded. Dividing time period Tc by the thermal resistance yields the thermal capacitance between chip 14 and heatsink 16. The thermal resistance and thermal capacitance are stored in memory 26.

Figure 4:
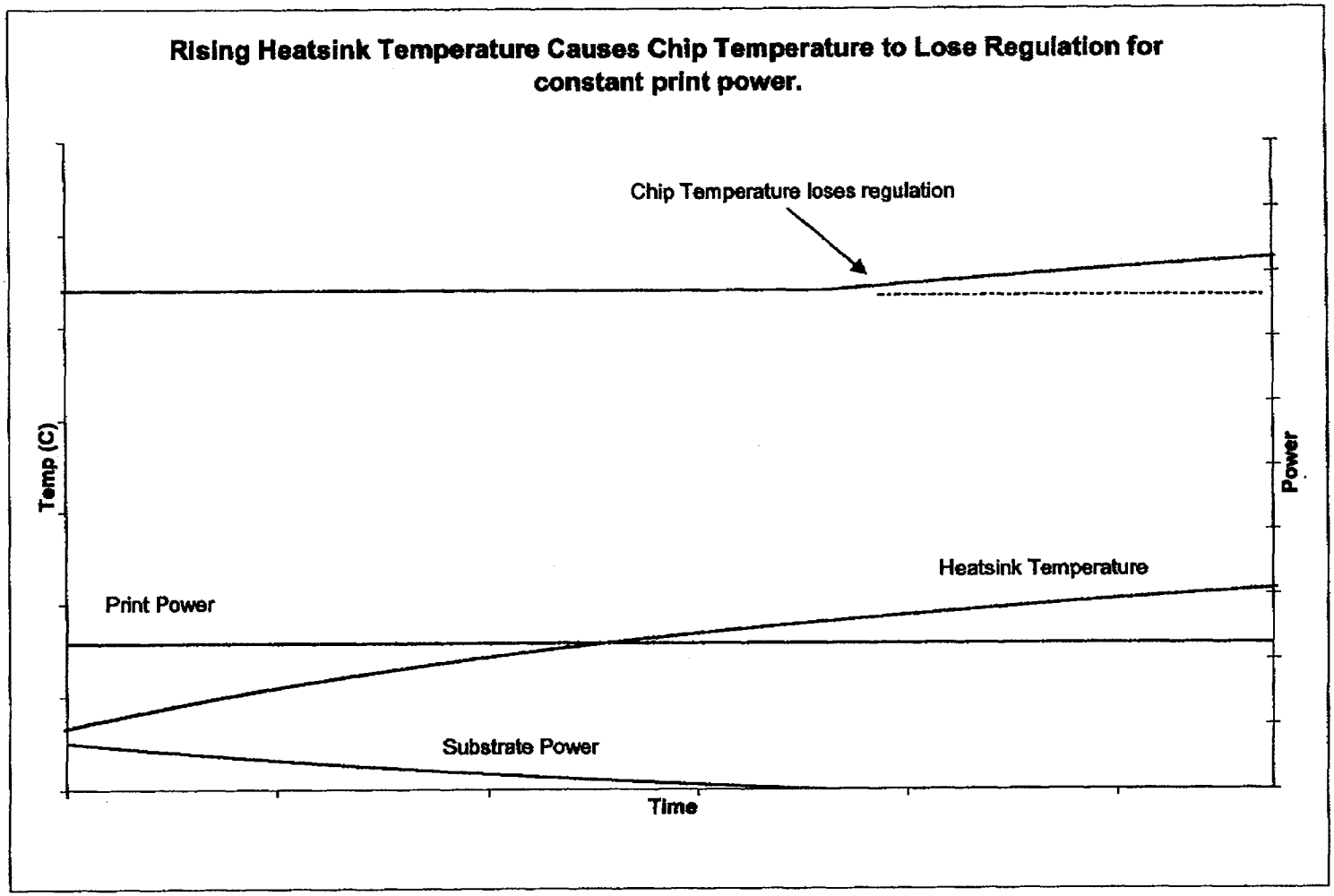
FIG. 4 is a plot of print chip temperature, heatsink temperature, print power and power applied to the substrate heaters during continuous printing.

FIG. 4 is a typical plot of temperatures of print chip 14 and heatsink 16 during continuous printing. The temperature of chip 14 is maintained at a desired target temperature by applying power to substrate heater 20. As the temperature of heatsink 16 increases, less total power in print chip 14 is required. If the print power exceeds the amount of power required to maintain chip 14 at its target temperature, then the temperature of chip 14 will drift up and a degradation in print quality may occur. In order to avoid this problem, the printer monitors or predicts the temperature of heatsink 16.

The numbers of drops in future swaths are counted, and the shingling method is altered if too many drops are counted, i.e., if the number of drops counted would drive the temperature of chip 14 to an unacceptably high level. With chip 14 being attached to heatsink 16, the temperature of heatsink 16 sets the upper limit of print density that will not cause the temperature of chip 14 to rise too high. Measurement of the temperature of heatsink 16 is enabled by the addition of electronics. Prediction of the temperature of heatsink 16 is possible by use of the following Equation (1):

$$\Delta V_2 = \Delta t^*\{(V_1 - V_2)/R_1 - V_2/R_2\}/C_2 \qquad \text{Equation (1),}$$

wherein t is time, $R_2$ and $C_2$ are thermal characteristics of heatsink 16, $V_1$ is the temperature of chip 14, $V_2$ is the predicted temperature of heatsink 16, and $R_1$ is the thermal resistance of chip 14 to heatsink 16.

In order to maintain uniform print quality, it is necessary to maintain the temperature of print chip 14 at a level that is a predetermined number of degrees above the temperature of the ambient air. The temperature of the ambient air can be quickly measured by using the temperature sense resistor 18 within print chip 14, even when chip 14 is mounted to a heatsink 16 whose temperature is not equal to the current ambient temperature.

Figure 5:
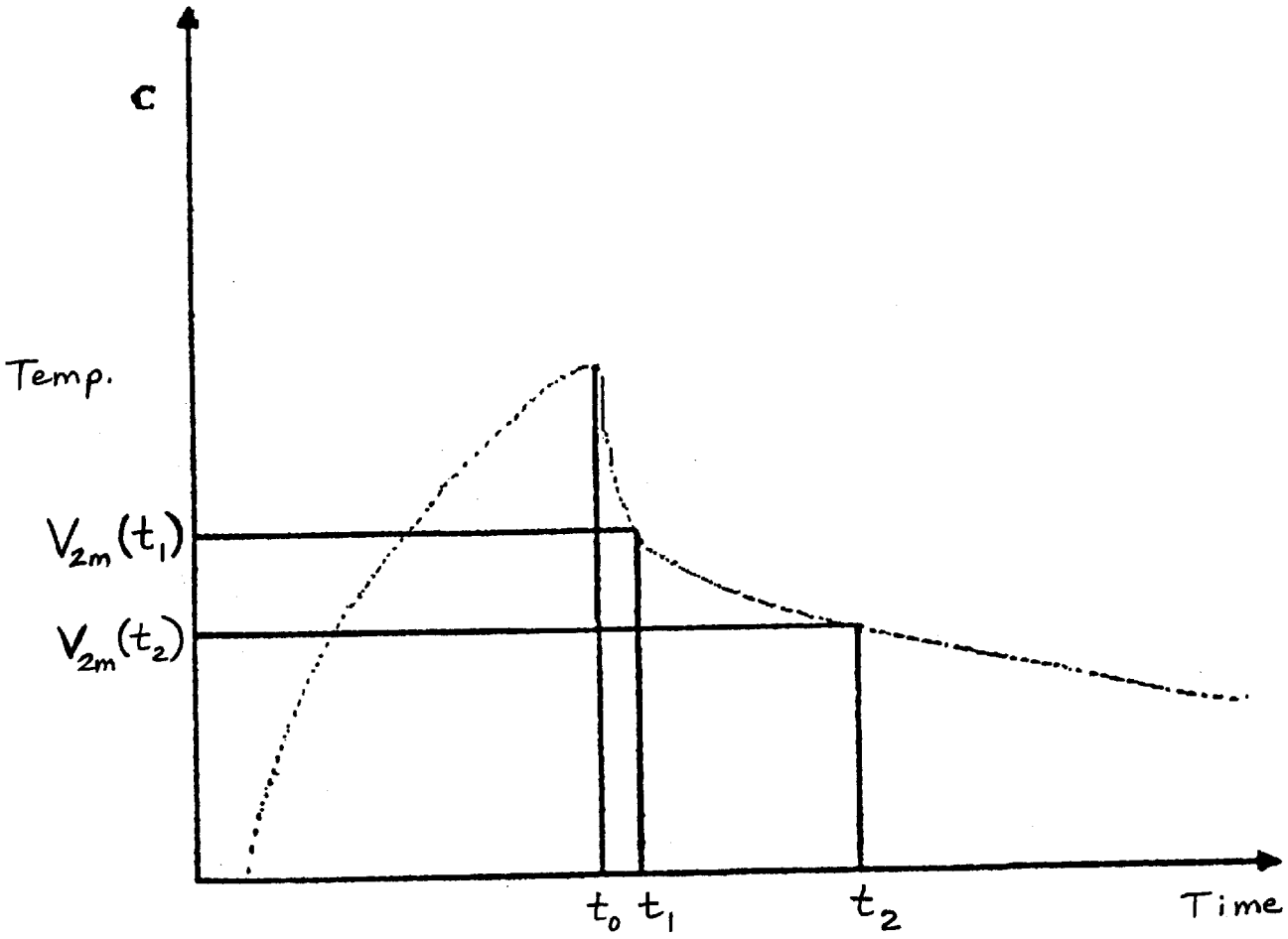
FIG. 5 is a plot of the temperature of a print chip attached to a heatsink.

The cooling temperature curve for the print chip 14 that is attached to heatsink 16 is shown in FIG. 5. Measurement of the ambient temperature can be made directly simply by waiting for the temperature of heatsink 16 to stop changing. The time required for this type of measurement can be as long as three to five minutes, dependent upon the size of heatsink 16. This measurement time can be reduced to approximately between ten and fifteen seconds by taking two temperature measurements a fixed time apart and performing an extrapolation to ascertain the ambient temperature.

An alternative method of determining the ambient temperature involves the use of non-volatile memory device 27. Whenever the printer does not apply thermal energy to printhead 10 either in the form of substrate heating or ejecting of ink for a time period much greater than the time constant of printhead 10, a measurement is made of the temperature of each printhead 10 in the printer. An average Ts of these temperature values, which is a measurement of the steady-state printer temperature, is stored in memory device 27. Whenever the printer is powered on, the temperature of each printhead 10 is measured, and an average Tv of these values is calculated. The lesser of Ts and Tv is used as a measurement of the ambient temperature.

Using the lesser of Ts and Tv as the ambient temperature is better than simply using the value Tv because, in the case where the printer has been used extensively, the temperatures of printheads 10 at power on would be substantially higher than the actual ambient temperature. In the case where Tv is used as the ambient temperature, Tv is periodically increased until it is equal to Ts. This incrementing of the ambient temperature until it reaches Ts is based on the heating characteristics of the printer itself.

By using any of the methods described above for determining ambient temperature, or by using any combination of the above-described methods, the ambient temperature can be measured without the need for a dedicated temperature sensor.

Figure 6:
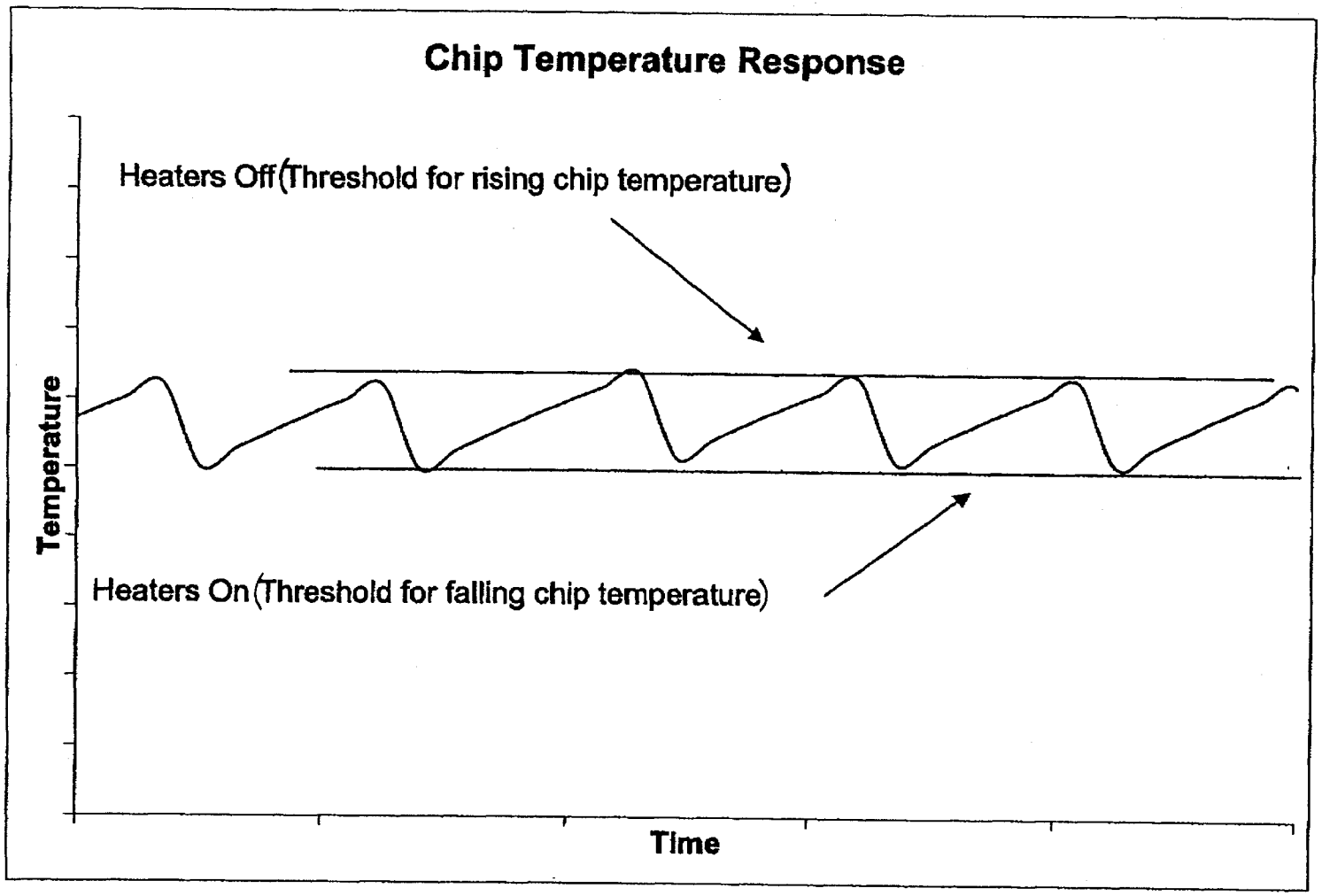
FIG. 6 is a plot of print chip temperature under the control of a control algorithm.

FIG. 6 is a plot of the temperature of print chip 14 under the control of the method of the present invention. When the temperature of chip 14 falls below the lower threshold temperature, power is applied to substrate heater 20. When the temperature of chip 14 exceeds the upper threshold temperature, the power to substrate heater 20 is turned off. The amount of power required to raise the temperature of chip 14 is directly related to thermal parameters within the printer which include the temperature of heatsink 16 and the thermal resistance of chip 14 to heatsink 16. Selection of a power level based on these parameters allows the temperature of chip 14 to be controlled more uniformly than if the maximum power level were selected. The level of power applied to substrate heater 20 can be selected according to the following Equation (3):

$$\text{Power}=(\text{Target Temperature}-\text{Heat Sink Temperature})/R1,$$

wherein R1 is the thermal resistance of chip 14 to heatsink 16.

The sequence for ink jetting thermal parameter calibration is identical to that for substrate heater thermal parameter calibration, except that instead of generating heat on chip 14 with substrate heater 20, the heat is generated by the ejection of ink. Information describing ink-jetting resistors 23 is stored in printhead memory 26 so that an appropriate amount of energy can be applied.

In summary, detailed information is stored in print chip memory 26 and is used to calculate the power being applied to printhead 10 during a calibration cycle. Calibration is performed when heating with chip substrate heater 20 and when jetting ink. The calibration cycle measures the thermal resistance of print chip 14 to heat sink 16, a parameter that can vary significantly from part to part. The calibration parameters are used to predict the temperature of heatsink 16. Prediction of the temperature of heatsink 16 is important because it determines the maximum print density that can be printed when using a constant temperature control algorithm. Ambient air temperature is measured by monitoring the cooling characteristics of the metal heat sink 16. The calibration parameters are used to improve the control of the temperature of print chip 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of controlling a temperature of a print chip of a printhead in an ink jet printer, said method comprising the steps of:

providing the printer with a memory device;

providing the printhead with at least one substrate heater;

providing the print chip with at least one ink-jetting resistor;

providing the printhead with a heatsink attached to the print chip;

applying power to at least one of said substrate heater and said ink-jetting resistor;

recording temperature data associated with the print chip during said applying step;

calculating at least one of a thermal resistance value of the print chip to said heatsink and a thermal capacitance value associated with the printhead, said calculating being dependent upon said recorded temperature data;

storing the at least one of a thermal resistance value of the print chip to said heatsink and a thermal capacitance value associated with the printhead in said memory device;

measuring a temperature of said heatsink based upon at least one of:

the at least one of a thermal resistance value of the print chip to said heatsink and a thermal capacitance value associated with the printhead;

a temperature of the print chip; and a thermal resistance value associated with said heatsink; and setting a level of power to be applied to said substrate heater, said setting step being dependent upon said temperature of said heatsink and the at least one of a thermal resistance value of the print chip to said heatsink and a thermal capacitance value associated with the printhead.

2. The method of claim 1, comprising the further step of providing a temperature sensing device one of attached to the print chip and formed integrally with the print chip, wherein each of said recording step and said measuring step are based upon an output of said temperature sensing device.

3. The method of claim 2, comprising the further step of determining the ambient temperature based upon said output of said temperature sensing device, and wherein said setting step is dependent upon said detennined ambient temperature.

4. The method of claim 1, wherein said calculating step includes dividing a change in temperature of said print chip by an amount of power applied in said applying step to thereby yield a measured thermal resistance value.

5. The method of claim 4, wherein said calculating step includes:

computing a temperature difference between a peak temperature of the print chip and an initial temperature of the print chip;

determining a cooling detection temperature by adding a predetermined fraction of the temperature difference to the initial temperature of the print chip;

ascertaining a time period between a time of termination of said applying step and a time at which a temperature of the print chip reaches the cooling detection temperature; and producing a thermal capacitance value by dividing the time period by the measured thermal resistance value.

6. The method of claim 5, wherein said initial temperature of the print chip is approximately equal to said temperature of said heatsink.

7. The method of claim 1, comprising the further step of attaching said memory device to the printhead.

8. The method of claim 1, comprising the further step of installing the printhead in the printer, wherein said applying, recording, calculating and storing steps are all performed substantially immediately after said installing step.

9. The method of claim 1, wherein said applying step comprises applying said power to said ink-jetting resistor while the printhead is in a spit location.

10. The method of claim 1, wherein said measuring step comprises at least one of monitoring and predicting said temperature of said heatsink.

11. A method of controlling a temperature of a print chip of a printhead in an ink jet printer, said method comprising the steps of:

providing a memory device within the printer;

providing the printhead with at least one substrate heater;

applying power to said substrate heater;

recording temperature data associated with the print chip during said applying step;

calculating at least one of a thermal resistance value associated with the printhead and a thermal capacitance value associated with the printhead, said calculating including dividing a change in temperature of said print chip by an amount of power applied in said applying step to thereby yield a measured thermal resistance value;

storing the at least one of a thermal resistance value associated with the printhead and a thermal capacitance value associated with the printhead in said memory device; and setting a level of power to be applied to said substrate heater, said setting step being dependent upon the at least one of a thermal resistance value associated with the printhead and a thermal capacitance value associated with the printhead.

12. The method of claim 11, comprising the further steps of:

attaching a heatsink to the print chip; and one of monitoring and predicting a temperature of said heatsink;

wherein said setting step is dependent upon said temperature of said heatsink.

13. The method of claim 12, wherein said predicting step is dependent upon the at least one of a thermal resistance value associated with the printhead and a thermal capacitance value associated with the printhead.

14. The method of claim 11, comprising the further step of providing a temperature sensing device attached to the print chip, wherein said recording step is based upon an output of said temperature sensing device.

15. The method of claim 14, comprising the further step of determining an ambient temperature based upon said output of said temperature sensing device, and wherein said setting step is dependent upon said determined ambient temperature.

16. The method of claim 11, wherein said calculating step includes:

computing a temperature difference between a peak temperature of the print chip and an initial temperature of the print chip;

determining a cooling detection temperature by adding a predetermined fraction of the temperature difference to the initial temperature of the print chip;

ascertaining a time period between a time of termination of said applying step and a time at which a temperature of the print chip reaches the cooling detection temperature; and producing a thermal capacitance value by dividing the time period by the measured thermal resistance value.

17. The method of claim 16, wherein said initial temperature of the print chip is approximately equal to a temperature of a heatsink attached to the print chip.

18. The method of claim 11, comprising the further step of attaching said memory device to the printhead.

19. The method of claim 11, comprising the further step of installing the printhead in the printer, wherein said applying, recording, calculating and storing steps are all performed substantially immediately after said installing step.

20. An ink jet printer comprising:

a printhead including:

a substrate heater;

a print chip; and a heatsink attached to said print chip;

a memory device storing a thermal resistance value of said print chip to said heatsink; and a controller configured to:

retrieve the thermal resistance value from said memory device; and set a level of power to be applied to said substrate heater dependent upon a temperature of said heatsink and the thermal resistance value of said print chip to said heatsink.

21. The ink jet printer of claim 20, wherein said print chip includes a temperature sensing device configured to output a temperature of said print chip, said controller being configured to predict said temperature of said heatsink based upon said temperature of said print chip.

* * * * *